US005247804A

United States Patent [19]

Paige et al.

[11] Patent Number: 5,247,804

[45] Date of Patent: Sep. 28, 1993

[54] METHOD AND APPARATUS FOR RECOVERING AND PURIFYING REFRIGERANT INCLUDING LIQUID RECOVERY

[75] Inventors: Lowell E. Paige, Penneville; Chester D. Ripka, Syracuse, both of N.Y.

[73] Assignee: Carrier Corporation, Syracuse, N.Y.

[21] Appl. No.: 31,754

[22] Filed: Mar. 15, 1993

Related U.S. Application Data

[63] Continuation of Ser. No. 612,642, Nov. 13, 1990, abandoned.

[51] Int. Cl.[5] ..... F25B 45/00

[52] U.S. Cl. ..... 62/77; 62/126; 62/149; 62/292

[58] Field of Search ..... 62/77, 85, 149, 292, 62/474, 475, 195

[56] References Cited

U.S. PATENT DOCUMENTS

| | | | |
|---|---|---|---|
| 4,766,733 | 9/1988 | Scuderi | 62/77 |
| 4,805,416 | 2/1989 | Manz et al. | 62/292 |
| 4,903,499 | 2/1990 | Merritt | 62/149 |

*Primary Examiner*—John M. Sollecito

[57] ABSTRACT

A refrigerant recovery system is operated to withdraw compressible refrigerant from a refrigeration system by first withdrawing liquid refrigerant from the system being serviced through a suitable conduit and delivering the withdrawn refrigerant directly to a refrigerant storage means. In the refrigerant storage means at least a portion of the refrigerant so withdrawn exists in gaseous form and a portion of this is withdrawn from the storage means and passed serially through a compressor, a condenser, and a refrigerant expansion device before being delivered back to the refrigerant storage means where is evaporates and absorbs heat from the refrigerant within the storage means thereby cooling the storage means and lowering the pressure therein to thereby increase the withdrawal of the liquid refrigerant from the refrigeration system through the conduit. The system controlled parameters including temperature of the refrigerant and the storage means, and compressor suction and discharge pressure are sensed. A detectable change in the value of these system control parameters occur at a time which may be correlated at a time at which the state of the refrigerant being withdrawn from the refrigeration system changes from liquid to vapor. This information is used to shift the system from a liquid recovery mode of operation to a vapor recovery mode.

4 Claims, 6 Drawing Sheets

VAPOR RECOVERY MODE

LOGIC DIAGRAM

LIQUID RECOVERY MODE

LOGIC DIAGRAM

RECYCLE MODE LOGIC DIAGRAM

REFRIGERANT RECOVERY/RECYCLE
UNIT COMPONENT/MODE CHART

| MODE | COMPONENT | | | | | | |
|---|---|---|---|---|---|---|---|
| | SV1 | SV2 | SV3 | SV4 | SV5/SV6 | SV7 | COMPRESSOR/COND FAN |
| STANDBY | CL | CL | CL | CL | CL | CL | OFF |
| SERVICE | OP | OP | OP | OP | CL | OP | OFF |
| RECOVERY (LIQUID) | OP | OP | CL | CL | CL | OP | ON |
| RECOVERY (VAPOR) | CL | OP | OP | OP | CL | CL | ON |
| CYCLINDER COOL | OP | OP | CL | CL | CL | CL | ON |
| RECYCLE | OP | OP | CL | OP | CL | CL | ON |
| TOTALEST | OP | OP | CL | OP | OP | CL | ON |
| RECHARGE | CL | CL | CL | CL | CL | OP | OFF |

NOTES: SOLENOID VALVES SV5 AND SV6 OPERATE TOGETHER AS A SINGLE OUTPUT FROM MICROPROCESSOR.

COMPRESSOR MOTOR/COND FAN MOTOR OPERATE TOGETHER AS A SINGLE OUTPUT FROM MICROPROCESSOR.

OP = OPEN (ENERGIZED)
CL = CLOSED (DE-ENERGIZED)
ON = ENERGIZED
OFF = DE-ENERGIZED

FIG.5

METHOD AND APPARATUS FOR RECOVERING AND PURIFYING REFRIGERANT INCLUDING LIQUID RECOVERY

This is a continuation of copending application Ser. No. 07/612,642 filed on Nov. 13, 1990 now abandoned.

BACKGROUND OF THE INVENTION

1. Field of the Invention

This invention relates to the recovery of, and purification of, compressible refrigerant contained in a refrigeration system. More specifically it relates to a method and apparatus for recovering an extremely high percentage of the refrigerant contained in a given system. In particular, it relates to a system having liquid and vapor recovery capabilities.

2. Description of the Prior Art

A wide variety of mechanical refrigeration systems are currently in use in a wide variety of applications. These applications include domestic refrigeration, commercial refrigeration, air conditioning, dehumidifying, food freezing, cooling and manufacturing processes, and numerous other applications. The vast majority of mechanical refrigeration systems operate according to similar, well known principals, employing a closed-loop fluid circuit through which a refrigerant flows. A number of saturated fluorocarbon compounds and azeotropes are commonly used as refrigerants in refrigeration systems. Representative of these refrigerants are R-12, R-22, R-500 and R-502.

Those familiar with mechanical refrigeration systems will recognize that such systems periodically require service. Such service may include removal, of, and replacement or repair of, a component of the system. Further during normal system operation the refrigerant can become contaminated by foreign matter within the refrigeration circuit, or by excess moisture in the system. The presence of excess moisture can cause ice formation in the expansion valves and capillary tubes, corrosion of metal, copper plating and chemical damage to insulation in hermetic compressors. Acid can be present due to motor burn out which causes overheating of the refrigerant. Such burn outs can be temporary or localized in nature as in the case of a friction producing chip which produces a local hot spot which overheats the refrigerant. The main acid of concern is HCL but other acids and contaminants can be produced as the decomposition products of oil, insulation, varnish, gaskets and adhesives. Such contamination may lead to component failure or it may be desirable to change the refrigerant to improve the operating efficiency of the system.

When servicing a refrigeration system it has been the practice for the refrigerant to be vented into the atmosphere, before the apparatus is serviced and repaired. The circuit is then evacuated by a vacuum pump, which vents additional refrigerant to the atmosphere, and recharged with new refrigerant. This procedure has now become unacceptable for environmental reasons, specifically, it is believed that the release of such fluorocarbons depletes the concentration of ozone in the atmosphere. This depletion of the ozone layer is believed to adversely impact the environment and human health. Further, the cost of refrigerant is now becoming an important factor with respect to service cost, and such a waste of refrigerant, which could be recovered, purified and reused, is no longer acceptable.

To avoid release of fluorocarbons into the atmosphere, devices have been provided that are designed to recover the refrigerant from refrigeration systems. The devices often include means for processing the refrigerants so recovered so that the refrigerant may be reused. Representative examples of such devices are shown in the following U.S. Pat. Nos.: 4,441,330 "Refrigerant Recovery And Recharging System" to Lower et al; 4,476,688 "Refrigerant Recovery And Purification System" to Goddard; 4,766,733 "Refrigerant Reclamation And Charging Unit" to Scuderi; 4,809,520 "Refrigerant Recovery And Purification System" to Manz et al; 4,862,699 "Method And Apparatus For Recovering, Purifying and Separating Refrigerant From Its Lubricant" to Lounis; 4,903,499 "Refrigerant Recovery System" to Merritt; and 4,942,741 "Refrigerant Recovery Device" to Hancock et al.

When most such systems are operating, a recovery compressor is used to withdraw the refrigerant from the unit being serviced. As the pressure in the service unit is drawn down, the pressure differential across the recovery compressor increases because the pressure on the suction side of the compressor becomes increasingly lower while the pressure on the discharge side of the compressor stays constant. High compressor pressure differentials can be destructive to compressor internal components because of the unacceptably high internal compressor temperatures which accompany them and the increased stresses on compressor bearing surfaces. Limitations on the pressure differentials or pressure ratio across the recovery compressors are thus necessary, such limitations, in turn can limit the percentage of the total charge of refrigerant contained within the unit being serviced that may be successfully recovered.

When using such recovery systems in servicing larger refrigeration systems it is particularly advantageous to have the capability of withdrawing refrigerant from the system in the liquid form and delivering it directly to a storage cylinder. The recovery of the refrigerant in liquid form, because of its much greater density, is obviously far quicker than recovery in the vapor state.

SUMMARY OF THE INVENTION

It is an object of the present invention to withdraw refrigerant in its liquid state directly from a refrigeration system being serviced and delivering it to a storage cylinder.

Another object of the invention is to cool the refrigerant storage cylinder during the liquid recovery mode to lower the pressure and temperature of the storage cylinder below ambient.

It is another object of the invention to operate a refrigerant recovery system in a liquid recovery mode and to shift to a vapor recovery mode when predetermined conditions in the recovery system are measured.

These and other obejcts of the invention are achieved by operating a refrigerant recovery system to withdraw compressible refrigerant from a refrigeration system by first drawing liquid refrigerant from the system being serviced through a suitable conduit and delivering the withdrawn refrigerant to a refrigerant storage means. In the refrigerant storage means at least a portion of the refrigerant so withdrawn exists in gaseous form. A portion of this gaseous refrigerant is withdrawn from the storage means and compressed to form a high pressure gaseous refrigerant. The high pressure gaseous refrigerant is then condensed to form a high pressure liquid refrigerant. The high pressure liquid refrigeant is passed through an expansion device where the refrigerant under goes a pressure drop and is at least partially flashed to a vapor. The liquid vapor mixture is then delivered to the storage means where it evaporates and absorbs heat from the refrigerant within the storage means thereby cooling the storage means and lowering the pressure therein, thereby increasing the withdrawal of liquid refrigerant from the refrigeration system through the conduit.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be best understood from the following description of the preferred embodiment when read in connection with the accompanying drawings wherein;

FIG. 5 is a chart showing the operation of the various components of the system during different modes of operation.

DESCRIPTION OF THE PREFERRED EMBODIMENT

Figure 1:
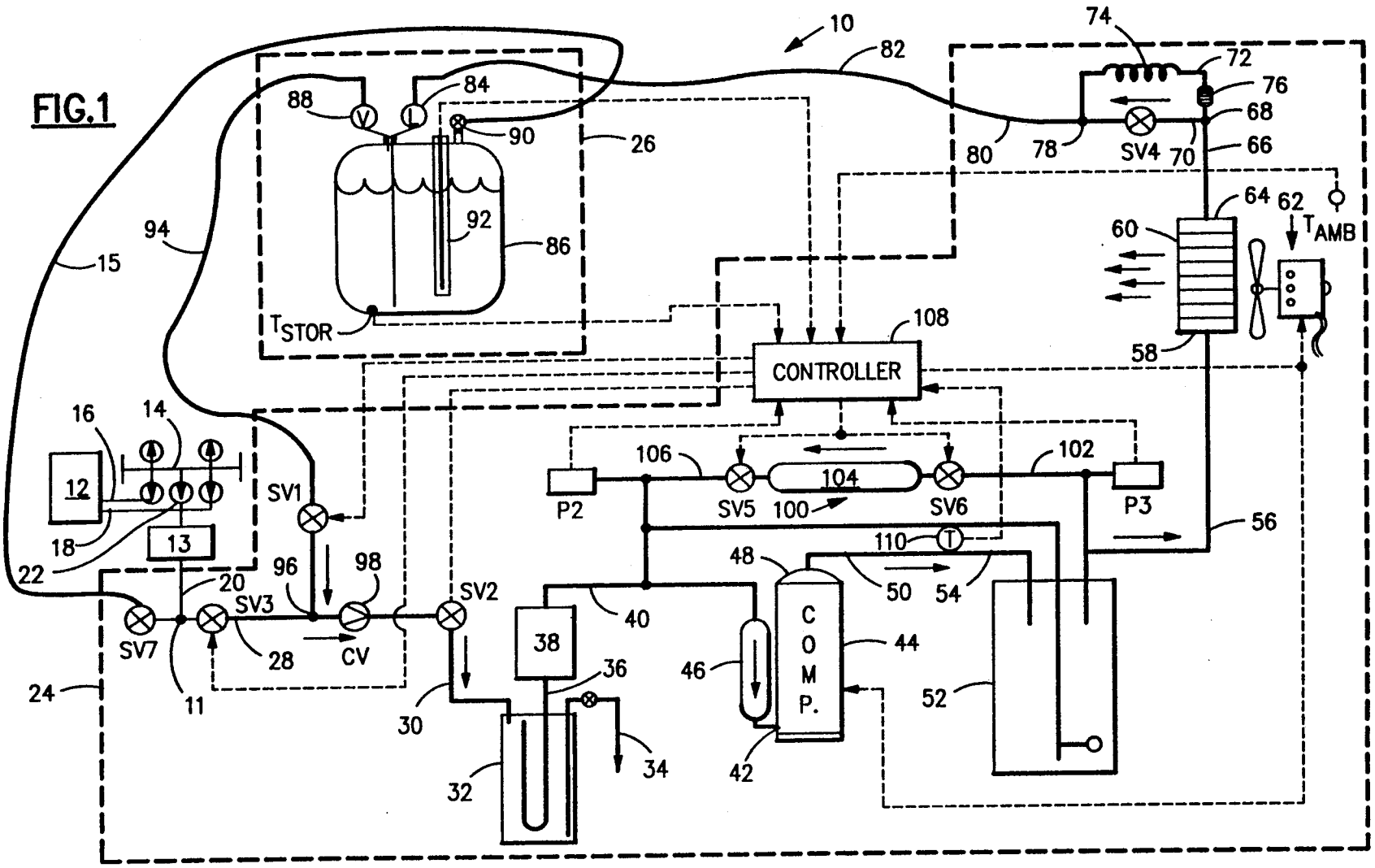
FIG. 1 is a diagrammatical representation of a refrigeration recovery and purifying system embodying the principles of the present invention.

An apparatus for recovering and purifying the refrigerant contained in a refrigeration system is generally shown at reference numeral 10 in FIG. 1. The refrigeration system to be evacuated is generally indicated at 12 and may be virtually any mechanical refrigeration system.

As shown the interface or tap between the recovery and purification system 10 and the system being serviced 12 is a standard gauge and service manifold 14. The manifold 14 is connected to the refrigeration system to be serviced in a standard manner with one line 16 connected to the low pressure side of the system 12 and another line 18 connected to the high pressure side of the system. A high pressure refrigerant line 20 is interconnected between the service connection 22 of the service manifold and a T connection 11 for coupling the line 20 to the recovery system 10.

Located in the interconnecting line 20 is a filter-dryer 13 which is mounted external of the recovery system. This device as will be seen, is normally installed in the line 20 only when the system is to be operated first in the liquid recovery mode of operation.

The recovery system 10 includes two sections, as shown in FIG. 1 the components and controls of the recovery system are contained within a self contained compact housing (not shown) schematically represented by the dotted line 24. A refrigerant storage section of the system is contained within the confines of the dotted lines 26. The details of each of these sections and their interconnection and interaction with one another will now be described in detail.

As will be appreciated as the description of the operation of the system continues there are two refrigerant paths extending from the T-connection 11 at the end of interconnecting line 20. The first path, i.e. the liquid path, extends to the left of the T-11 to an electrically actuatable solenoid valve SV7. This valve will selectively allow refrigerant to pass therethrough when actuated to its open position or will prevent the flow of refrigerant therethrough when electrically actuated to its closed position. Additional electrically acutatable solenoid valves contained in the system operate in the same conventional manner. From SV7 a liquid refrigerant line 15 extends to the refrigerant storage section of the system 26 where it communicates through a valve 90 with a refrigerant storage cylinder 86. In the liquid recovery mode of operation of the system liquid refrigerant passes through the line 15 directly from the refrigeration system 12 to the storage cylinder 86.

When the system is operated in the vapor recovery mode gaseous refrigerant flowing through the interconnecting line 20 flows through the T-11 and to the right to electrically acuatable solenoid valve SV3. From SV3 refrigerant passes through a conduit 28 through a check valve 98 to a second electrically acuatable solenoid valve SV2. From SV2 an appropriate conduit 30 conducts the refrigerant to the inlet of a combination accumulator/oil trap 32 having a drain valve 34. Refrigerant gas is then drawn from the oil trap through conduit 36 to an acid purification filter-dryer 38 where impurities such as acid, moisture, foreign particles and the like are removed before the gases are passed via conduit 40 to the suction port 42 of the compressor 44. A suction line accumulator 46 is disposed in the conduit 42 to assure that no liquid refrigerant passes to the suction port 42 of the compressor. The compressor 44 is preferably of the rotary type, which are readily commercially available from a number of compressor manufacturers but may be of any type such as reciprocating, scroll or screw.

From the compressor discharge port 48 gaseous refrigerant is directed through conduit 50 to a conventional float operated oil separator 52 where oil from the recovery system compressor 44 is separated from the gaseous refrigerant and directed via float controlled return line 54 to the conduit 40 communicating with the suction port of the compressor. From the outlet of the oil separator 52 gaseous refrigerant passes via conduit 56 to the inlet of a heat exchanger/condenser coil 60. An electrically actuated condenser fan 62 is associated with the coil 60 to direct the flow of ambient air through the coil as will be described in connection with the operation of the system.

From the outlet 64 of the condenser coil 60 an appropriate conduit 66 conducts refrigerant to a T-connection 68. From the T 68 one conduit 70 passes to another electrically actuated solenoid valve SV4 while the other branch 72 of the T passes to a suitable refrigerant expansion device 74. In the illustrated embodiment the expansion device 74 is a capillary tube and a strainer 76 is disposed in the refrigerant line 72 upstream from the capillary tube to remove any particles which might potentially block the capillary. It should be appreciated that the expansion device could comprise any of the other numerous well known refrigerant expansion devices which are widely commercially available. The conduit 72 containing the expansion device 74 and the conduit 70 containing the valve SV4 rejoin at a second T connection 78 downstream from both devices. It will be appreciated that the solenoid valve SV4 and the expansion device 74 are in a parallel fluid flow relationship. As a result, when the solenoid valve SV4 is open the flow of refrigerant will be, because of the high resistance of the expansion device, through the solenoid valve in a substantially unrestricted manner. On the other hand, when the valve SV4 is closed, the flow of refrigerant will be through the high resistance path provided by the expansion device. Combination devices such as electronically actuated expansion valves are known which would combine the functions of the valves SV4 and the capillary tube 74, however, as configured and described above, the desired function is obtained at a minimum cost.

From the second T-78 a conduit 80 passes to an appropriate coupling (not shown) for connection of the system as defined by the confines of the line 24, via a flexible refrigerant line 82 to the liquid inlet port 84 of the previously referred to refillable refrigerant storage container 86. The container 86 is of conventional construction and includes a second port 88 adapted for vapor outlet. The storage cylinder 86 further includes a liquid level indicator 92. The liquid level indicator, for example, may comprise a compact continuous liquid level sensor of the type available from Imo Delaval Inc., Gems Sensors Division. Such an indicator is capable of providing an electrical signal indicative of the level of the refrigerant contained within the storage cylinder 86.

Refrigerant line 94 interconnects the vapor outlet 88 of the cylinder 86 with a T connection 96 in the conduit 28 extending between solenoid valve SV3 and solenoid valve SV2. An additional electrically actuated solenoid valve SV1 is located in the line 94. A check valve 98 is also positioned in the conduit 28 at a location downstream of the T-96 which is adapted to allow flow in the direction from SV3 to SV2 and to prevent flow in the direction from SV2 to SV3.

With continued reference to FIG. 1 a refrigerant gas contamination detection circuit 100 is included in the system in a parallel fluid flow arrangement with the compressor 44. The contamination detection circuit 100 includes an inlet conduit 102 in fluid communication with the conduit 56 extending from the oil separator 52 to the condenser inlet 58. The inlet conduit 102 has an electrically actuated solenoid valve SV6 disposed there along and from there passes to the inlet of a sampling tube holder 104. The outlet of the sampling tube holder 104 is interconnected via conduit 106 with the conduit 40 which communicates with the suction port 42 of the compressor. An electrically controlled solenoid valve SV5 is disposed in the conduit 106.

The solenoid valves SV5 and SV6, when closed, isolate the sampling tube holder 104 from the system and allow easy replacement of the sampling tube contained therein. The sampling tube holder may be of the type described in U.S. Pat. No. 4,389,372 Portable Holder Assembly for Gas Detection Tube. Further, the refrigerant contaminant testing system is preferably of the type shown and described in detail in U.S. Pat. No. 4,923,806 entitled Method and Apparatus For Refrigerant Testing In A Closed System and assigned to the assignee of the present invention. Each of the above identified patents is hereby incorporated herein by reference in its entirety.

Automatic control of all of the components of the refrigerant recovery system 10 is carried out by an electronic controller 108 which is formed of a microprocessor having a memory storage capability and which is micro-programmable to control the operation of all of the solenoid valves SV1 through SV7 as well as the compressor motor and the condenser fan motor. Inputs to the controller 108 include a number of measured or sensed system control parameters. In the embodiment disclosed these control parameters include the temperature of the storage cylinder Tstor which comprises a temperature transducer capable of accurately providing a signal indicative of the temperature of the refrigerant in the storage cylinder 86. Ambient temperature is measured by a temperature transducer positioned at the inlet to the condenser coil or condenser fan 62 and is referred to as Tamb. The temperature of the refrigerant flowing through the compressor discharge line 50 is sensed by a temperature transducer 110 positioned on the compressor discharge line 50.

Most important in the control scheme of the systems are the compressor suction pressure designated as P2 and the compressor discharge pressure designated as P3. As indicated in FIG. 1 a pressure transducer labeled P2 is in fluid flow communication with the suction line 40 to the compressor while a second pressure transducer P3 is in fluid communication with the high pressure refrigerant line 56 passing to the condenser. The pressure ratio across the compressor 44 is defined as the ratio P3/P2. An additional input to the controller 108 is the signal from the liquid level indicator 92.

Looking now at FIG. 5 it will be noted that the operating modes of the system are identified and the condition of the electrically acuatable components of the system are shown in the different modes. In the Standby mode the system has been turned on and all electrically actuatable mechanical systems are de-energized and ready for operation. In the Service mode, the electrically actuated solenoid valves SV1 through SV4 are all open thereby equalizing the pressures within the system so that it may be serviced without fear of encountering high pressure refrigerant.

The liquid recovery mode will now be described in detail in connection with the flow chart of FIG. 2A. It should be appreciated that the liquid recovery mode is designed to be used in larger systems for example systems having a refrigerant charge of greater than 5 pounds of refrigerant. In systems where less than 5 pounds of refrigerant are contained in the system the liquid recover mode of operation may be omitted and the operator may go directly to the vapor recover cycle which will be subsequently described.

At this point it is assumed that a system containing greater than 5 pounds of refrigerant is being serviced and that the device 10 has been coupled to the system 12 for removal of refrigerant therefrom. With preference now to FIG. 2A and FIG. 5 it will be seen that upon initiation of the Liquid Recover mode the controller 108 will open valves SV1, SV2 and SV7. The valves SV3, SV4, SV5 and SV6 will remain closed. Valves SV5 and SV6 as noted in FIG. 5 operate together as a single output from the microprocessor (controller 108) and the only time these valves are open is when the contaminant testing process is being carried out. These valves will not be discussed further in connection with other modes of operation of the system. The motors of the compressor 44 and the condensor fan 62 are also energized upon initiating the liquid recover mode.

Looking now at operation of the system in the liquid recover mode, and referring to FIG. 1. With valve SV3 closed and valve SV7 open refrigerant from the system being serviced 12 is forced by the pressure of the refrigerant in the system through conduit 20, through the T-11, through valve SV7 and via liquid refrigerant line 15 to the valve 90 on the refrigerant storage cylinder 86 and directly into refrigerant storage cylinder.

Upon entering the storage cylinder 86 at ambient conditions, a portion of the liquid refrigerant will exist in gaseous form. At this time because, the selonoid valve SV1 is open, a fluid path is directly established between the vapor outlet 88 of the storage cylinder 86 and the conduit 94 which is in communication with the low pressure side of the compressor 44. With the selnoid valve SV4 closed refrigerant passing from the condensors 60 will pass through the refrigerant expansion device 74.

Accordingly with the control solenoids set as described above, during liquid recovery, the compressor 44 acts to withdraw low pressure gaseous refrigerant directly from the storage cylinder 86. This refrigerant passes via conduit 94 and T-96. through the check valve 98, valve SV2 and conduit 30 to the oil separator 32. From the oil separator it passes via conduit 36 to the filter drier 38, and thence via conduit 40 and accumulator 46 to the compressor 44 delivers high pressure gaseous refrigerant via conduit 50 to the oil separator 52. From the oil separator 52 the high pressure gaseous refrigerant passes via conduit 56 to the condensor coil 60 where the hot compressed gas condenses to a liquid.

Liquified refrigerant leaves the condensing coil 60, via conduit 66 and passes through the T-connectin 68 through the strainer 76 and, via conduit 72 to the refrigerant expansion device 74. The thus condensed refrigerant, at a high pressure, flows through the expansion device 74 where the refrigerant undergoes a pressure drop, and is at least partially flashed to a vapor. The liquid-vapor mixture then flows via conduit 78 and 82 back to the refrigerant storage cylinder 86 where it evaporates and absorbs heat from the refrigerant within the cylinder 86 thereby lowering the pressure and temperature within the storage cylinder 86. As a result of the lowered temperature and pressure within the storage cylinder 86 the pressure differential between the refrigeration system being serviced 12, which is at ambient temperature, and the storage tank 86 is substantially increased and as a result the flow of liquid refrigerant through the liquid refrigerant line 15 to the storage cylinder is substantially increased.

It will be appreciated, that during this mode of operation refrigerant will continue to recirculate through the cooling and purifying circuit described above.

Figure 2B:
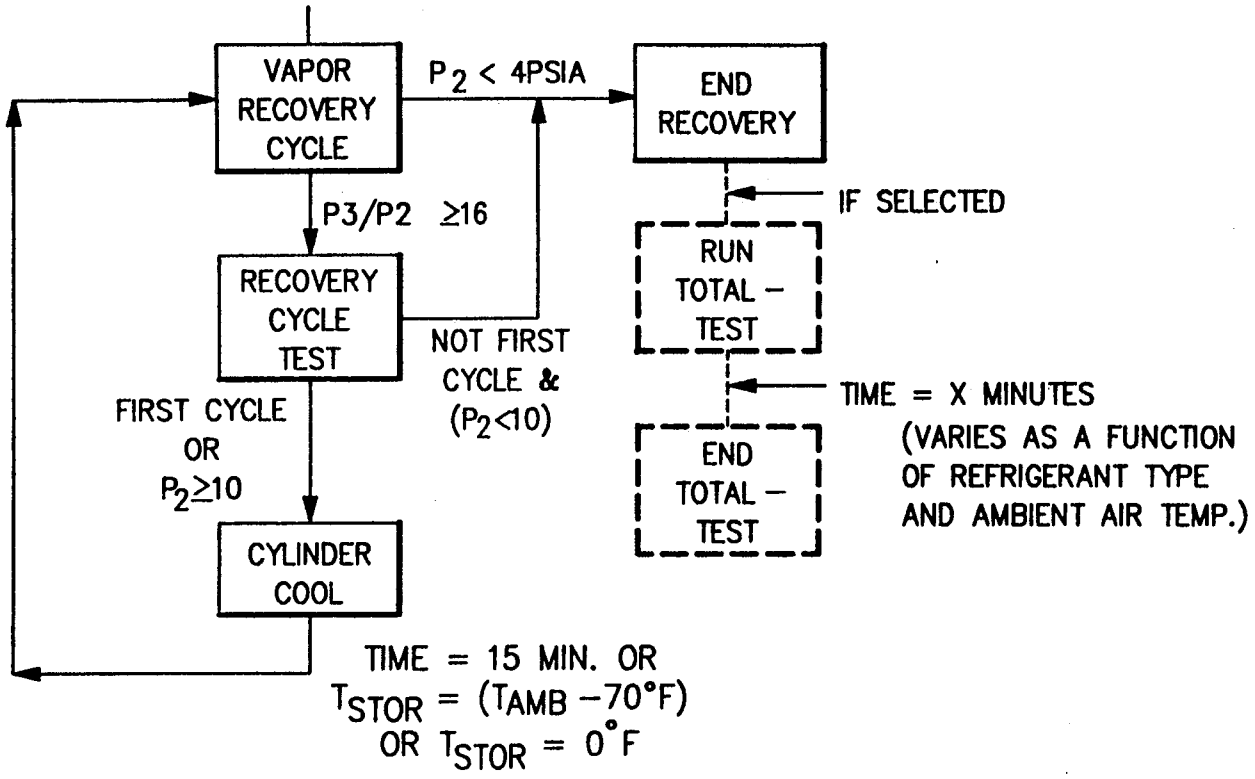
FIG. 2B is a continuation of the flow chart of FIG. 2A showing an exemplary program for controlling the system in a vapor recovery mode of operation.
Figure 2:
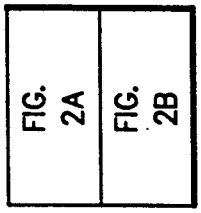
FIG. 2 shows the relationship between FIGS. 2A and 2B.
Figure 2A:
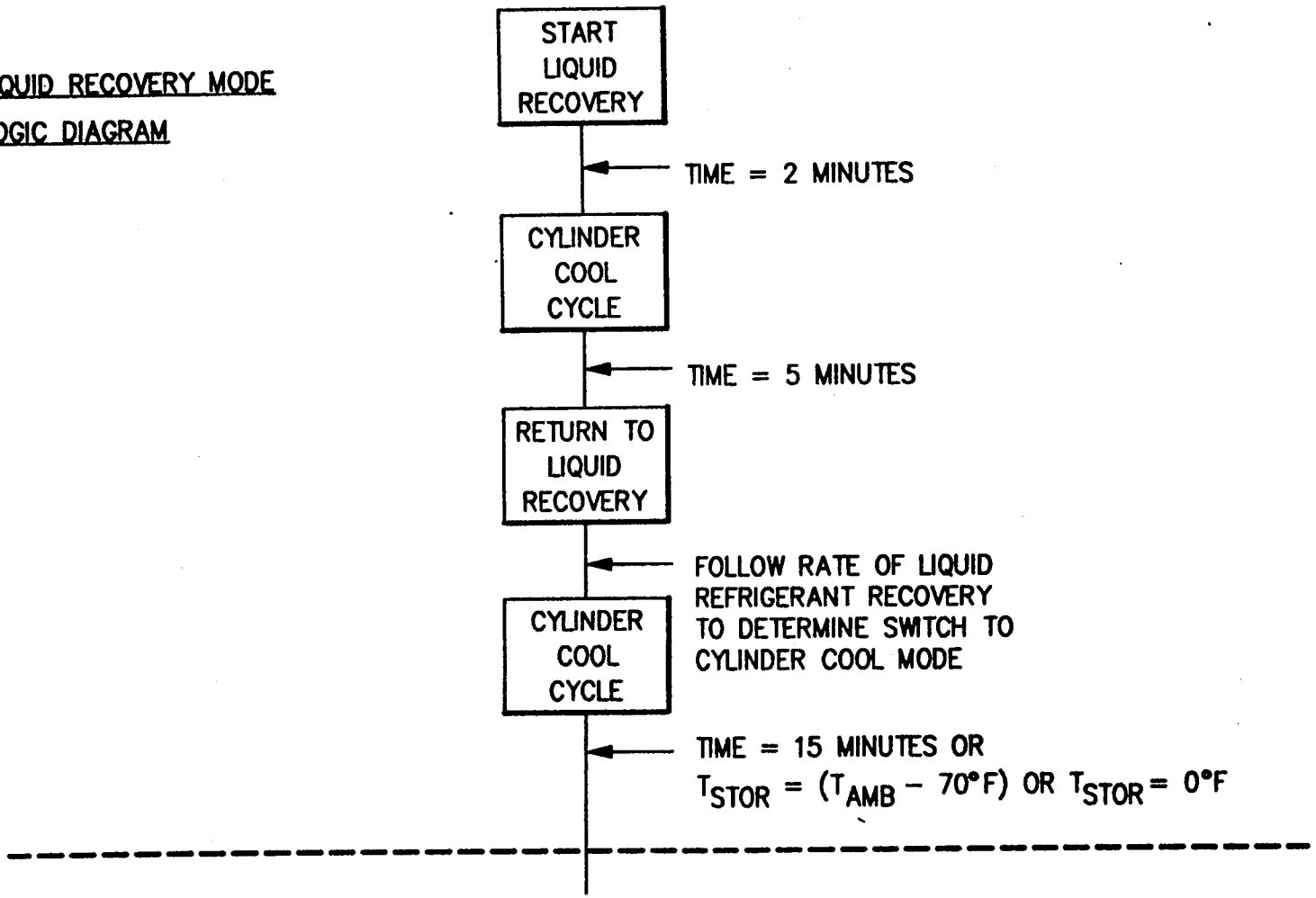
FIG. 2A is a flow chart of an exemplary program for controlling the system in a liquid recovery mode of operation.

With reference to FIG. 2A it will be seen that the liquid recovery mode is run according to the illustrated embodiment, for two minutes at which time the system is shifted to the Cylinder Cool cycle. With reference to FIG. 5, the only difference between the operation of the system in the Cylinder Cool cycle and the liquid recovery cycle is that the solenoid value SV7 is closed and the system operates in a closed circuit, as described with no connection to the system being serviced. As the Cylinder Cool mode of operation continues the cylinder temperature continues to drop as the refrigerant is continuously circulated through the closed refrigeration circuit. Also during this time the refrigerant is passed through the refrigeration purifying components, i.e. the oil separator 32 and the filter dryer 38, a plurality of times to thereby further purify the refrigerant. The system is run in the Cylinder Cool cycle for five minutes in order to assure that the temperature and pressure within the storage cylinder is reduced such that it is substantially lower than ambient temperature.

At this point, with continued reference to FIG. 2A the system returns to liquid recovery operation. As the second liquid recovery cycle continues the controller 108 continues to receive the signal generated by the liquid level sensor 92 which is indicative of the liquid level within the storage cylinder 86. The processor receives a succession of these signals and determines a rate of liquid level increase in the storage cylinder 86. The processor then generates a signal indicative of the rate of liquid level increase. The processor is further programmed to look at the signal indicative of the rate of liquid level increase and determine whether that rate is commensurate with the withdrawal of liquid refrigerant from the system.

Figure 3:
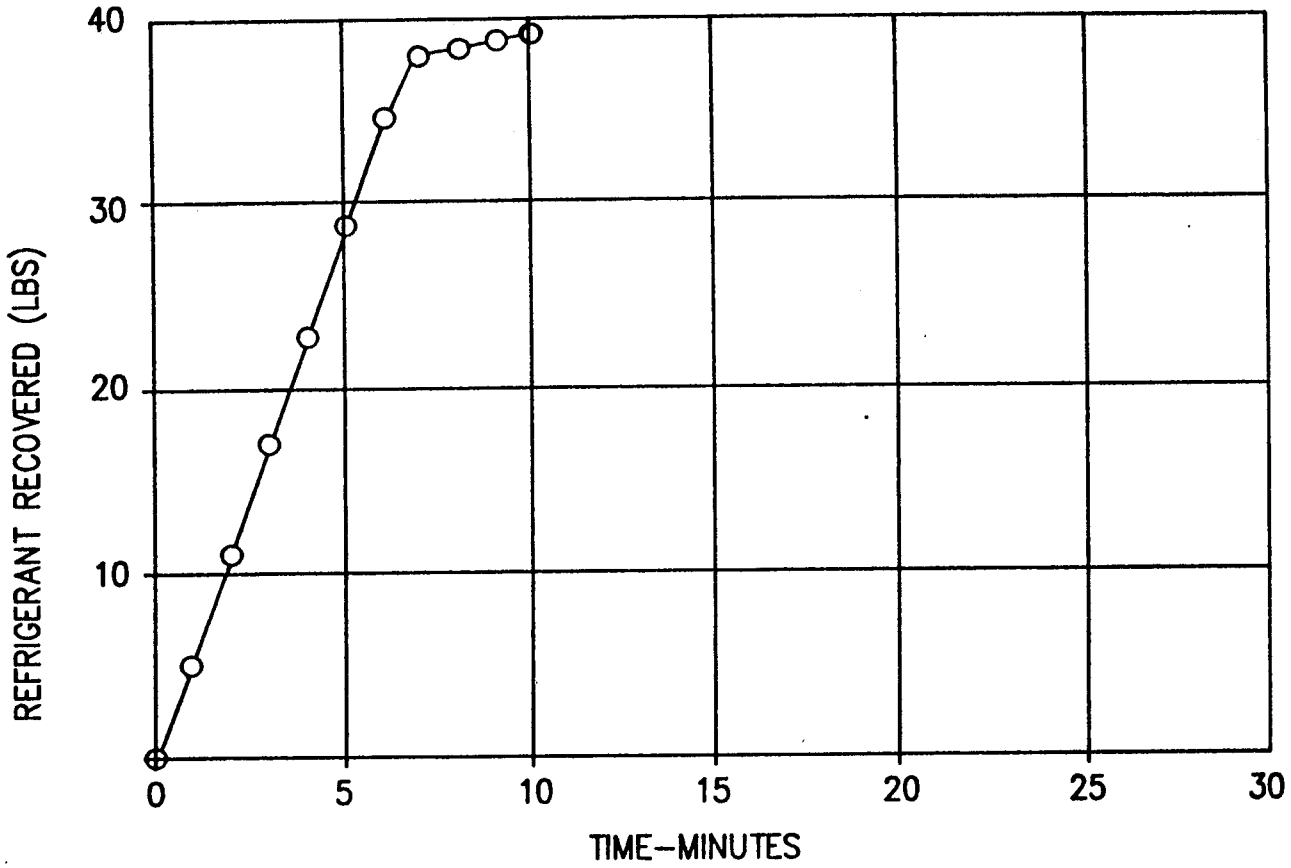
FIG. 3 is a graphical showing of quantity of refrigerant recovered versus time in the liquid recovery mode of operation.

FIG. 3 lillustrates the decrease change in the rate of refrigerant recovery, and, accordingly, the decrease in the rate of increase of the liquid level within the cylinder 86 which occurs when the recovery of refrigerant shifts from a liquid to a vapor state. The straight line of the portion of the graph illustrates the linear increase in the amount of refrigerant recovered as time goes by when recovery is in the liquid state. At the top of the graph where the slope changes dramatically the rate of refrigerant being recovered is in the vapor. When the microprocessor senses the dramatic change in the rate that refrigerant is being recovered the liquid recovery mode of operation is automatically terminated.

The accuracy of the information which liquid level sensors are able to provide varies widely. The operation of the Liquid Recovery system as described above is such that the system will perform a successful recovery using a level sensor that provides less accurate readings. In a system using an extremely accurate level sensor the Liquid Recovery mode of operation described above, as outlined in FIG. 2A, may be performed by omitting the first Cylinder Cool cycle and the return to Liquid Recovery cycle.

With reference to FIG. 2A it will be seen that at this point the system shifts to a Cylinder Cool cycle of operation in order to reduce the temperature and pressure of the storage cylinder 86 prior to the beginning of a vapor recovery cycle. With continued reference to FIG. 2A, this Cylinder Cool mode of operation will terminate when any one of three conditions occur; 1) the cylinder temperature, as measured by Tstor falls to a level 70° F. below ambient temperature (Tamb), or, 2) when the cylinder cool mode of operation has gone for a duration of 15 minutes, or, 3) when the cylinder temperature Tstor falls to 0° F. Regardless of which of the three conditions triggers termination of the Cylinder Cool mode, the result is substantially the same, i.e., the temperature (Tstor) of the refrigerant stored in the cylinder 86 is well below ambient temperature. At this point the system will shift to a vapor recovery mode of operation to complete the withdrawal of the refrigerant from the system being serviced.

The Vapor Recover and Cylinder Cool modes will now be described in detail in connection with the flow chart of FIG. 2B. It should be appreciated that a vapor recovery cycle may begin under two different sets of circumstances; 1) in the case of a system containing more than five pounds of refrigerant the vapor recovery cycle will follow a previously performed liquid recovery cycle of operation; and 2) in the case of a refrigeration system containing less than five pounds of refrigerant the vapor recover cycle represents the initiation of the recovery sequence. As the description of the Vapor Recover and Cylinder Cool modes proceeds, some of the description will be redundant, however, for the sake of a complete understanding of the operation of the Vapor Recover and Cylinder Cool modes a complete description from initial hookup to a refrigeration or air conditioning system 12 will be given.

The Vapor Recover mode is the mode in which the device 10 has been coupled to an air conditioning system 12 for removal of refrigerant therefrom. Upon initiation of the Recover mode the controller 108 will open valves SV2, SV3 and SV4. Valves SV1, SV5, SV6 and SV7 will remain closed. The compressor 44 and the condenser fan 62 are also actuated upon initiation of the Recover mode.

Looking now at operation of the system in the Recover mode, and referring to FIG. 1, with valve SV3 open refrigerant from the system being serviced 12 is forced by the pressure of the refrigerant in the system, and by the suction created by operation of the compressor 44, through conduit 20, through valve SV3, check valve 98, valve SV2 and conduit 30 to the accumulator-/oil trap 32. Within the accumulator/oil trap the oil contained in the refrigerant being removed from the system being serviced falls to the bottom of the trap along with any liquid refrigerant withdrawn from the system. Gaseous refrigerant is drawn from the accumulator/oil trap 32 through the filter dryer 38 where moisture, acid and any particulate matter is removed therefrom, and, from there passes via conduit 40, through the suction accumulator 46 to the compressor 44.

The compressor 44 compresses the low pressure gaseous refrigerant entering the compressor into a high pressure gaseous refrigerant which is delivered via conduit 50 to the oil separator 52. The oil separated from the high pressure gaseous refrigerant in the separator 52 is the oil from the recovery compressor 44 and this oil is returned via conduit 54 to the suction line 40 of the compressor to assure lubrication of the compressor. From the oil separator 52 the high pressure gaseous refrigerant passes via conduit 56 to the condenser coil 60 where the hot compressed gas condenses to a liquid. Liquified refrigerant leaves the condensing coil 60 via conduit 66 and passes through the T68 through the open solenoid valve SV4, and passes via the liquid lines 80 and 82, to the refrigerant storage cylinder 86 through liquid inlet port 84.

While refrigerant recovery is going on the controller 108 is receiving signals from the pressure transducers P3 and P2, calculating the pressure ratio P3/P2, and, comparing the calculated ratio to a predetermined value. Compressor suction pressure P2 is also being looked at alone and being compared to a predetermined Recovery Termination Suction Pressure. As shown in FIG. 2, the predetermined Recovery Termination Suction Pressure is 4 psia, and if P2 falls below this value the Recover mode is terminated and the controller 108 initiates the refrigerant quality test cycle, identified as Totaltest. This cycle will be described below following a complete description of the other modes of operation. TOTALTEST is a registered Trademark of Carrier Corporation for "Testers For Contaminants in A Refrigerant".

The selection of the predetermined recovery termination suction pressure of 4 psia results from recovery system operation wherein it has been shown that a compressor suction pressure, P2, of 4 psia or less results in recovery of 98 to 99% of the refrigerant from the system being serviced. Achieving this pressure during the first Recover mode cycle is unusual, however, it is achievable. As an example, P2 may be drawn down to the 4 psia termination value in low ambient temperature conditions where the condensing coil temperature (which is ambient air cooled) is low enough to allow P3 to remain low enough for P2 to reach 4 psia before the pressure ratio limit is reached.

Returning now to compressor pressure ratio, as indicated in FIG. 2, in the illustrated embodiment, when the pressure ratio exceeds or is equal to 16 the microprocessor in the controller 108 performs what is referred to as the Recovery Cycle Test. If the Recovery Cycle just performed is the first Recovery Cycle performed and the compressor suction pressure P2 is greater than or equal to 10 psia the system will shift to what is known as a Cylinder Cool mode of operation. If the Recovery Cycle just performed is a second or subsequent recovery cycle and the compressor suction pressure P2 is less than 10 psia the controller will consider the refrigerant Recovery as completed and will initiate the refrigerant contaminant test cycle (Totaltest).

The latter conditions, i.e. second or subsequent recover cycle, and P2 less than 10 psia, are conditions that are found to exist at high ambient temperatures. For example, such conditions may exist when recovering R-22 from an air conditioning system at an ambient temperature of 105° F. and above. Under such conditions it has been found that attempts to reduce the compressor suction pressure P2 to values less than 10 psia are counterproductive in that a substantial length of operating time would be necessary in order to obtain a very small additional drop in suction pressure. Further, it has been found, at these conditions, that shifting to the Cylinder Cool mode, which will be described below, also would not substantially increase the amount of refrigerant that would ultimately be withdrawn from the system and accordingly termination of the Recover mode and initiation of the refrigerant contaminant test cycle is indicated.

Assuming that the Recovery Cycle Test has indicated that either: it is the first recovery cycle, or, the compressor suction pressure P2 is greater than or equal to 10 psia, the controller 108 will initiate the Cylinder Cool mode of operation.

In the Cylinder Cool mode, as indicated in FIG. 5, the solenoid valves SV1 and SV2 are energized and thereby in the open condition. Solenoid valves SV3 and SV4 are closed, and, the compressor motor and condenser fan motor continue to be energized. The Cylinder Cool mode of operation essentially converts the system to a closed cycle refrigeration system wherein the refrigerant storage cylinder 86 functions as a flooded evaporator. By closing solenoid valve SV3 the refrigerant recovery and purification system 10 is isolated from the refrigeration system 12 being serviced. The opening of solenoid valve SV1 establishes a fluid path between the vapor outlet 88 of the storage cylinder 86 and the conduit 28 which is in communication with the low pressure side of the compressor 44. The closing of solenoid valve SV4 routes the refrigerant passing from the condenser 60 through the refrigerant expansion device 74.

With the control solenoids set as described above, in the Cylinder Cooling mode of operation the compressor 44 compresses low pressure gaseous refrigerant entering the compressor and delivers a high pressure gaseous refrigerant via conduit 50 to the oil separator 52. From the oil separator 52 the high pressure gaseous refrigerant passes via conduit 56 to the condenser coil 60 where the hot compressed gas condenses to a liquid. Liquified refrigerant leaves the condensing coil 60 via conduit 66 and passes through the T-connection 68 through the strainer 76 and, via conduit 72, to the refrigerant expansion device 74. The thus condensed refrigerant, at a high pressure, flows through the expansion device 74 where the refrigerant undergoes a pressure drop, and is at least partially, flashed to a vapor. The liquid-vapor mixture then flows via conduits 78 and 82 to the refrigerant storage cylinder 86 where it evaporates and absorbs heat from the refrigerant within the cylinder 86 thereby cooling the refrigerant.

Low pressure refrigerant vapor then passes from the storage cylinder 86, via vapor outlet port 88, through conduit 94 and solenoid valve SV1 to the T connection 96. From there it passes through the check valve 98, solenoid valve SV2, oil separator/accumulator 32, filter dryer 38 and conduit 40 to return to the compressor 44, to complete the circuit.

As the Cylinder Cool mode of operation continues, the cylinder temperature, as measured by the temperature transducer Tstor, continues to drop as the refrigerant is continuously circulated through the closed refrigeration circuit. Also during this time the refrigerant is passed through the refrigeration purifying components, i.e. the oil separator 32 and the filter dryer 38, a plurality of times to thereby further purify the refrigerant.

Referring again to FIG. 2, the Cylinder Cool mode of operation will terminate when any one of three conditions occur; 1) the cylinder temperature, as measured by Tstor falls to a level 70° F. below ambient temperature (Tamb), or, 2) when the Cylinder Cooling mode of operation has gone on for a duration of 15 minutes, or, 3) when the cylinder temperature Tstor falls to 0° F. Regardless of which of the three conditions has triggered the termination of the Cylinder Cool mode the result is substantially the same, i.e., the temperature (Tstor) of the refrigerant stored in the cylinder 86 is now well below ambient temperature. As a result, the pressure within the cylinder, corresponding to the lowered temperature is substantially lower than any other point in the system.

When any one of the Cylinder Cool mode termination events occur, the controller 108 will shift the system to a second Recover mode of operation. In the second Recover mode the solenoid valves, and compressor and condenser motors are energized as described above in connection with the first Recover mode. Because of the low temperature Tstor that has been created in the refrigerant storage cylinder, however, the capability of the system to withdraw refrigerant from the unit being serviced, without subjecting the recovery compressor to high pressure differentials is dramatically increased.

An understanding of this phenomenon will be appreciated with reference to FIG. 1. It will be described by picking up a Recover cycle at the point where refrigerant withdrawn from the system being serviced is discharged from the compressor 44 and is passing, via conduit 56, to the condenser 60. At this point the pressure within the system, extending from the compressor discharge port 48 through to and including the storage cylinder 86, is dictated by temperature and pressure conditions within the storage cylinder 86. As a result the storage cylinder 86 now effectively serves as a condenser with the recovered refrigerant passing as a super- heated vapor through the condenser coil, through the solenoid valve SV4 and the conduits 80 and 82 to the storage cylinder 86 where it is condensed to liquid form.

It is the dramatically lower compressor discharge pressure P3 experienced during a second or subsequent Recover mode (i.e. any Recover mode following a Cylinder Cool mode) that allows the recovery compressor 44 to draw the system being serviced 12 to a pressure lower than heretofore obtainable while still maintaining a permissible pressure ratio across the recovery compressor.

It will be appreciated that in a second Recover mode, the pressure ratio P3/P2 could exceed the predetermined value (which in the example given is 16) and, depending upon the other system conditions, as outlined in the flow chart of FIG. 2, will result in an additional Cylinder Cool mode of operation or termination.

With continued reference to FIG. 2, the system will then operate as described until conditions exist which result in the controller 108 switching to the refrigerant contaminant test (Totaltest) mode of operation. Prior to initiation of a Recover cycle an operator should make sure that a sampling tube has been placed in the sampling tube holder 104. Upon initiation of the TOTALTEST mode of operation, solenoid valves SV1, SV2, SV4 and SV5/SV6 are all energized to an open position. The solenoid valve SV3 is not energized and is therefore closed. With the flow control valves in the condition described the flow of refrigerant through the recovery system is similar to that described above in connection with the Cylinder Cooling mode except that the solenoid valve SV4 is open and therefore the refrigerant does not pass through the expansion device 74. With the refrigerant flowing through the circuit in this manner, and with the solenoid valves SV5 and SV6 open, the pressure differential existing between the high and low pressure side of the system induces a flow of refrigerant through conduit 102 solenoid valve SV6, the sampling tube holder 104 (and the tube contained therein), solenoid valve SV5 and conduit 106 to thereby return the refrigerant being tested to the suction side of the compressor 44.

A suitable orifice is provided in conduit 102, or in the sampling tube holder 104, to provide the necessary pressure drop to assure that the flow of refrigerant through the testing tube held in the sampling tube holder 104 is at a rate that will assure that the testing tube will receive the proper flow of refrigerant therethrough during the TOTALTEST run time in order to assure a reliable test of the quality of the refrigerant passing therethrough. With reference to FIG. 2 will be noted that the run time of the refrigerant quality test is indicated as X minutes. The normal run time for a commercially available TOTALTEST system is about ten minutes and the controller may be programmed to run the test for that length of time or different time for different refrigerants. The quality test however may be terminated sooner if the refrigerant being tested contains a large amount of acid and the indicator in the test tube changes color in less than the programmed run time. If this occurs, the refrigerant quality test may be terminated, and, an additional refrigerant purification cycle initiated.

Figure 4:
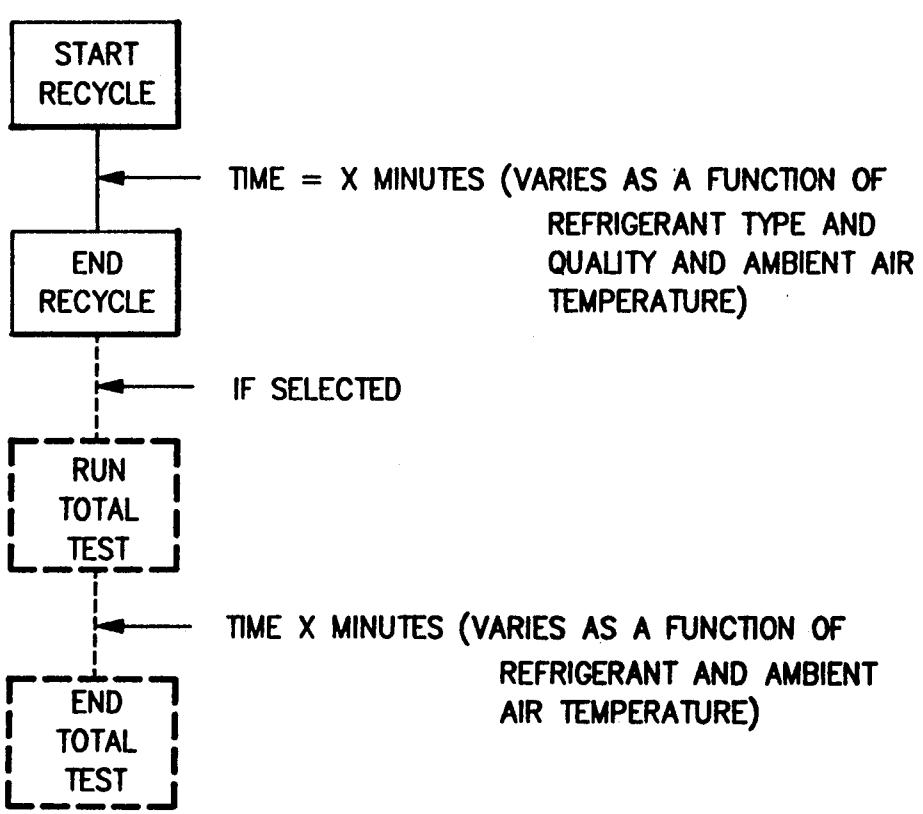
FIG. 4 is a flow chart of an exemplary program for controlling the system in a recylce mode of operation.

The additional purification cycle is identified as the Recycle mode and a flow chart showing the system operating logic is shown in FIG. 4. With reference to FIG. 4 it will be noted that the condition of the electrically actuable components is the same in Recycle as it is for the Cylinder Cool mode except that the solenoid valve SV4 is open so that the refrigerant does not flow through the expansion device 74 but flows through the open solenoid valve SV4. This increases the volume flow of refrigerant through the system during the Recycle mode. The function of this mode is strictly to further purify the refrigerant by multiple passes through the oil trap 32 and the filter dryer 38.

With reference to FIG. 4 the length of time in which the system is run in the Recycle mode is determined by the operator as a number of minutes "X" which varies as a function of refrigerant type and quality and ambient air temperature. The type of refrigerant is known, the ambient temperature may be measured, and the quality is determined by the operator upon the evaluation of the test tube used in the refrigerant quality test cycle. With continued referenced to FIG. 4, upon the end of the selected recycle timem the system, if so selected by the operator, will run another refrigerant quality test, and, if the results of this test so indicate another recycle period may initiated following the procedure set forth above.

The object of the system and control scheme described above is to remove as much refrigerant as possible from a system being serviced, under any given ambient conditions, or system conditions, while, at all times monitoring system control parameters which will assure that the compressor of the Recovery system is not subjected to adverse operating conditions. As described above, the system control parameter is the pressure ratio P3/P2, across the recovery compressor 44. In the example given above a value of P3/P2 of 16 was used as the pressure ratio above which the compressor could be adversely affected. It should be appreciated that for different compressors the value of this parameter could be different.

The ultimate goal in the control of this system is to limit compressor operation to predetermined limits to assure long and reliable compressor life. As pointed out above, in the Background of the Invention. the internal compressor temperature is considered by compressor experts to be the controlling factor in preventing internal compressor damage during operation. In the presently disclosed preferred embodiment the pressure ratio has been found to be an extremely reliable effective control parameter which may be related to the internal compressor temperature and has thus been selected as the preferred control parameter in the above described preferred embodiment. Pressure differential, (i.e. $P_3$-$P_2$) could also be effectively used to control the system.

It should be appreciated however, that other system control parameters such as the compressor discharge temperature as measured by the temperature transducer 110 in the compressor discharge line 50, or the compressor suction pressure P2 could also be used to control the operation of the system, to limit the system to operation only at conditions at which the compressor is not adversely effected.

With respect to temperature, it is generally agreed that an internal compressor temperature at which the lubricating oil begins to break down is about 325° F. Above this temperature adverse compressor operation and damage may be expected. In the present system the controller 108 has been programmed such that, should the compressor discharge temperature, monitored by the temperature transducer 110 exceed a maximum of 225° F. regardless of pressure ratio conditions, the system will be shut off.

It is further contemplated that, if the compressor discharge temperature, as measured at the transducer 110 were used as the primary system control parameter that a temperature in the neighborhood of 200° F. would be used to switch the recovery system from a Recover mode to a Cylinder Cooling mode of operation in order to assure that the compressor would not be adversely affected during operation of the system.

According to another control method, as mentioned above, the system control parameter being sensed for compressor protection could be the compressor suction pressure P2. In this case the microprocessor of the controller 108 would be programmed with compressor suction pressures P2 which would be considered indicative of adverse compressor operation, for a range of ambient air temperatures and for the different refrigerants which may be processed by the system. As an example, when processing refrigerant R-22 at an ambient air temperature of 90° F. a suction pressure P2 in the range of 13 psia to 15 psia would be programmed to change the system from a Recover mode toylinder Cooling mode of operation.

The outstanding refrigerant recovery capability of a system according to the present invention is reflected in the following example. The recovery apparatus was connected to a refrigeration system having a system charge of 40.0 pounds of refrigerant R-22 at an ambient temperature of 70° F. Such a system is typical of a large central air condition system.

Upon initation of liquid recovery the system performed the liquid recovery sequence for a duration of 15 minutes before shifting to the vapor recovery mode of operation. At the point of initiation of vapor recovery 37.7 pounds had been recovered from the system. Vapor recovery was then initiated and ran for 10 minutes during which time an additional 2.1 pounds of refrigerant was recovered. At this point, the total run time had been 25 minutes and a total of 39.8 pounds of refrigerant had been recovered from the system. This represents 99.5% of the total charge of 40.0 pounds, leaving only 0.2 pounds in the system.

The outstanding refrigerant recovery capability of a system according to the present invention is further reflected in the following example of vapor recovery only. The recovery apparatus was connected to a refrigeration system having a system charge of 4.5 pounds of refrigerant R-12 at an ambient temperature of 70° F. Such a system is typical of an automobile air conditioning system.

Upon initiation of recovery the system performed a first Recover cycle for 8.67 minutes before the system reached the limiting pressure ratio $P_2/P_3$ of 16. At that point 3.73 pounds had been recovered from the system. This represents 82.9% of the systems total charge. Typical prior art systems would stop at this point, leaving 0.77 pounds, or more than 17% of the charge in the system. This 0.77 pounds would eventually be released to the atmosphere.

At this point, the system shifted to the Cylinder Cool mode of operation. The Cylinder Cool cycle ran for 15 minutes, bringing the cylinder temperature (Tstor) down to 10° F. At this point a second Recover cycle was initiated by the system controller. The second Recover cycle ran for 3.8 minutes at which time Recover was terminated when the suction pressure P2 fell to 4.0 psia.

At this point, the total system run time had been 27.5 minutes and a total of 4.42 pounds of refrigerant had been recovered from the system. This represents 98.2% of the total charge of 4.5 pounds, leaving only 0.08 pounds in the system.

Following completion of recovery and purification, the storage cylinder 86 contains clean refrigerant which may be returned to the refrigeration system. With reference to FIG. 4, the Recharge mode, when selected, results in simultaneous opening of valves SV1 and SV3 to establish a direct refrigerant path from the storage cylinder 86 to the refrigeration system 12. All other valves and the compressor and condenser are de-energized in this mode. The amount of refrigerant to be delivered to the system is selected by the operator, and, the controller 108, with input from the liquid level sensor 92 will assure accurate recharge of the selected quantity of refrigerant to the system.

This invention may be practiced or embodied in still other ways without departing from the spirit or central character thereof. The preferred embodiments described herein are therefore illustrative and not restricted. The scope of the invention being indicated by the appended claims and all variations which come within the meaning of the claims are intended to be embraced therein.

What is claimed:

1. Apparatus for recovering compressible refrigerant from a refrigeration system comprising:

an interconnecting line extending from the refrigeration system to the apparatus for recovering compressible refrigerant;

first conduit means for connecting the interconnecting line to said means for storing refrigerant;

compressor means for compressing gaseous refrigerant delivered thereto, said compressor means having a suction port and discharge port;

second conduit means for connecting said means for storing refrigerant to the suction port of said compressor;

condenser means for withdrawing heat from and at least partially condensing refrigerant passing therethrough, said condensing means having an inlet and an outlet;

third conduit means for connecting said discharge port of said compressor means with said inlet of said condenser means;

fourth conduit means for connecting said outlet of said condenser with said means for storing refrigerant; refrigerant expansion means disposed in said fourth conduit means;

refrigerant expansion means disposed in said fourth conduit means;

first valve means operable between open and closed conditions disposed in said first conduit means;

fifth conduit means for connecting the interconnecting line with said suction port of said compressor means;

second valve means operable between open and closed conditions and disposed in said fifth conduit, and means for operating said first valve means to an open position and said second valve means to a closed position wherein the apparatus will withdraw liquid refrigerant from the refrigeration system through said first conduit, and for operating said first valve means to a closed position and said second valve means to an open position to withdraw gaseous refrigerant from the refrigeration system through said fifth conduit.

2. The apparatus of claim 1 further including means for sensing the level of liquid within said means for storing refrigerant and for generating a signal indicative of the liquid level within said means for storing refrigerant;

processor means for receiving a succession of said signals indicative of liquid level and for determining a rate of liquid level increase within said means for storing refrigerant and for generating a signal indicative of the rate of liquid level increases;

processor means for receiving the signal indicative of the rate of liquid level increase and for operating said first valve means to an open condition and said second valve means to a closed condition in response to said rate of liquid level increase exceeding a predetermined value of rate of liquid level increase which is indicative of the recovery of liquid refrigerant from the refrigeration system, and for operating said first valve means to a closed condition and said second valve means to an open condition in response to said signal indicative of rate of liquid level increase falling below said predetermined value of the rate of liquid level increase which is indicative of the recovery of liquid from the refrigeration system.

3. A method for recovering compressible refrigerant from a refrigeration system comprising the steps of:

a. withdrawing the liquid refrigerant from a refrigeration system through a conduit;

b. delivering, via the conduit, the withdrawn liquid refrigerant to a refrigerant storage means where at least a portion of the withdrawn refrigerant wall exist in gaseous form;

c. withdrawing a portion of the gaseous refrigerant from the storage means;

d. compressing the portion of gaseous refrigerant to form a high pressure gaseous refrigerant;

e. condensing the high pressure refrigerant to form high pressure liquid refrigerant;

f. expanding the high pressure liquid refrigerant;

g. delivering the expanded refrigerant back to the storage means to lower the pressure in the storage means, thereby increasing the withdrawal of liquid refrigerant from the refrigeration system through the conduit;

h. terminating the withdrawal of liquid refrigerant from the refrigeration system;

i. continuing to preform steps "b" through "g" for a predetermined period of time, whereby the temperature in the storage means is further reduced; and j. resuming withdrawal of liquid refrigerant from the refrigeration system after said predetermined time.

4. The method of claim 3 further including the steps of:

sensing the level of liquid within said storage means;

generating successive signals indicative of the liquid level within said storage means;

processing said succession of signals indicative of liquid level and determining a rate of liquid level increase within said storage means;

generating a signal indicative of the rate of liquid level increase; and when the signal indicative of the rate of liquid level increase falls below a predetermined value of which value is indicative of recovery of liquid refrigerant ceasing to preform steps a, b, and c, and commencing withdrawal of gaseous refrigerant from the refrigeration system through a second conduit;

compressing the gaseous refrigerant to form a high pressure gaseous refrigerant;

condensing the high pressure gaseous refrigerant to form high pressure liquid refrigerant; and delivering the liquid refrigerant to the storage means.

* * * * *